US007343722B1

(12) United States Patent
Rutten

(10) Patent No.: US 7,343,722 B1
(45) Date of Patent: Mar. 18, 2008

(54) UNWRAPPING STRETCH FILM FROM A PALLETIZED LOAD

(75) Inventor: J. Bradley Rutten, Circle Pines, MN (US)

(73) Assignee: Task Automation, Circle Pines, MN (US)

( * ) Notice: Subject to any disclaimer, the term of this patent is extended or adjusted under 35 U.S.C. 154(b) by 0 days.

(21) Appl. No.: 11/562,858

(22) Filed: Nov. 22, 2006

(51) Int. Cl.
*B65B 43/26* (2006.01)

(52) U.S. Cl. ..... 53/381.2; 53/381.1; 242/615.3

(58) Field of Classification Search ..... 53/492, 53/381.1, 381.2; 242/526, 527, 533, 533.2, 242/579, 615.3; 414/412
See application file for complete search history.

(56) References Cited

U.S. PATENT DOCUMENTS

| | | | | |
|---|---|---|---|---|
| 2,925,228 | A * | 2/1960 | Hayner et al. | 242/533 |
| 2,946,559 | A * | 7/1960 | Pickett | 254/395 |
| 3,070,355 | A * | 12/1962 | Wyatt | 254/396 |
| 5,148,651 | A | 9/1992 | Masuda et al. | |
| 5,282,346 | A | 2/1994 | Masuda et al. | |
| 5,463,841 | A | 11/1995 | Hayakawa et al. | |
| 5,573,226 | A * | 11/1996 | Smith | 242/615.3 |
| 5,725,349 | A | 3/1998 | Garvey et al. | |
| 5,727,747 | A | 3/1998 | Hannen et al. | |
| 5,911,666 | A | 6/1999 | Lancaster, III et al. | |
| 6,651,922 | B1 * | 11/2003 | Quimpo | 242/526 |
| 6,766,630 | B2 | 7/2004 | Rutten | |

FOREIGN PATENT DOCUMENTS

| | | |
|---|---|---|
| JP | 4858995 | 8/1973 |
| JP | 4995788 | 9/1974 |
| JP | 1111642 | 4/1989 |
| JP | 2166033 | 6/1990 |
| WO | WO03070573 A3 | 8/2003 |

* cited by examiner

*Primary Examiner*—Louis Huynh
(74) *Attorney, Agent, or Firm*—Fredrikson & Byron, P.A.

(57) ABSTRACT

An apparatus for unwrapping stretch film from a palletized load. The unwrapping apparatus can also include a spooler unit for collecting the film after the film has been cut by the cutting unit. The spooler unit can include a roller guide having two roller members which can be selectively positioned in one of an open position or a closed position. The spooler unit can include a stripper plate, one or more spooler forks, and a shuttle pin. The shuttle pin can be movable within a channel of the stripper plate to rotate within close proximity of one spooler fork during rotation of the spooler unit.

24 Claims, 11 Drawing Sheets

UNWRAPPING STRETCH FILM FROM A PALLETIZED LOAD

FIELD OF THE INVENTION

Embodiments of the invention generally relate to unwrapping and disposing of stretch film from a palletized load.

BACKGROUND OF THE INVENTION

Generally, the most common method used for removing stretch film from a palletized load (e.g., including a plurality of stacked items) is to manually cut and remove the film from the load. As can be appreciated, such manual cutting and removal of the stretch film has many disadvantages. First, the method can be relatively dangerous (e.g., due to one generally handling a cutting device). In addition, the method can be time consuming (e.g., due to such loads typically being large in size, one often needs to walk around and/or climb above the load to effectively cut and remove the stretch film). As a result, such manual removal of stretch film can be very costly to businesses that repetitively receive stretch film wrapped loads. However, in today's marketplace, using stretch film to bundle stacked item loads has been found to be both effective and relatively inexpensive. As such, the practice of using stretch film in this manner is not likely to be replaced anytime soon.

To remedy the relatively dangerous, time-consuming, and costly shortcomings of the above-described manual method, many types of apparatus have been designed to automatically cut and/or remove stretch film or other wrapping from such loads. However, many of these apparatus types fall short of providing cost effective, low-maintenance, and/or ergonomic approaches to cutting and/or removing the stretch film.

U.S. Pat. No. 6,766,630 to Rutten teaches apparatus and methods used to automatically cut and remove stretch film or other wrapping from a load. Such apparatus and methods are provided therein to enable cost effective, low-maintenance, and ergonomic techniques of removing and cutting stretch film. Enhancements which are applicable not only to the teachings of the '630 patent, but also to teachings related to other such unwrapping apparatus and/or methods, are described and illustrated herein.

SUMMARY

Embodiments of the invention provide a cost effective, low-maintenance, and ergonomic apparatus for cutting and removing stretch film from a palletized load having a plurality of items, such as bottles, stacked thereon.

In certain embodiments, an unwrapping apparatus is provided for removing and disposing of stretch film or other wrapping from a plurality of articles palletized on a pallet. The apparatus includes a frame made up of at least two upright legs. The upright legs are operatively connected to maintain a space therebetween, the space being suitable for accommodating the palletized load. At least one gripper is configured for engaging the film and pulling the film from the load. The at least one gripper is connected respectively to one of the upright legs, and is movable toward and away from the load to effectuate pulling of the film. The apparatus includes a cutting unit carrying a cutting tool for cutting the film. The cutting unit is carried by the frame and is movable upward/downward and toward/away from the load. The unwrapping apparatus further includes a spooler unit carried by the frame for collecting the film after the film has been cut by the cutting unit.

In certain embodiments of the invention, the spooler unit includes a roller guide for aligning the cut film when collected by the spooler unit. The roller guide includes at least two roller members which can be selectively positioned in one of an open position or a closed position. The roller members in their open positions form a region over which the cut film can be pulled and subsequently secured to the spooler unit. The roller members in their closed positions form an aperture through which the cut film can be pulled during collection of the cut film by the spooler unit.

In certain embodiments of the invention, the spooler unit comprises a stripper plate, one or more spooler forks, and a shuttle pin. The shuttle pin is movable within a channel of the stripper plate to rotate within close proximity of one spooler fork during rotation of the stripper plate. The shuttle pin and the one spooler fork form a narrow space therebetween during rotation of the spooler unit. The narrow space accommodates a portion of the cut film and enables the shuttle pin and the one spooler fork to secure the cut film portion during collection of the cut film by the spooler unit.

DETAILED DESCRIPTION OF PREFERRED EMBODIMENTS

Figure 1:
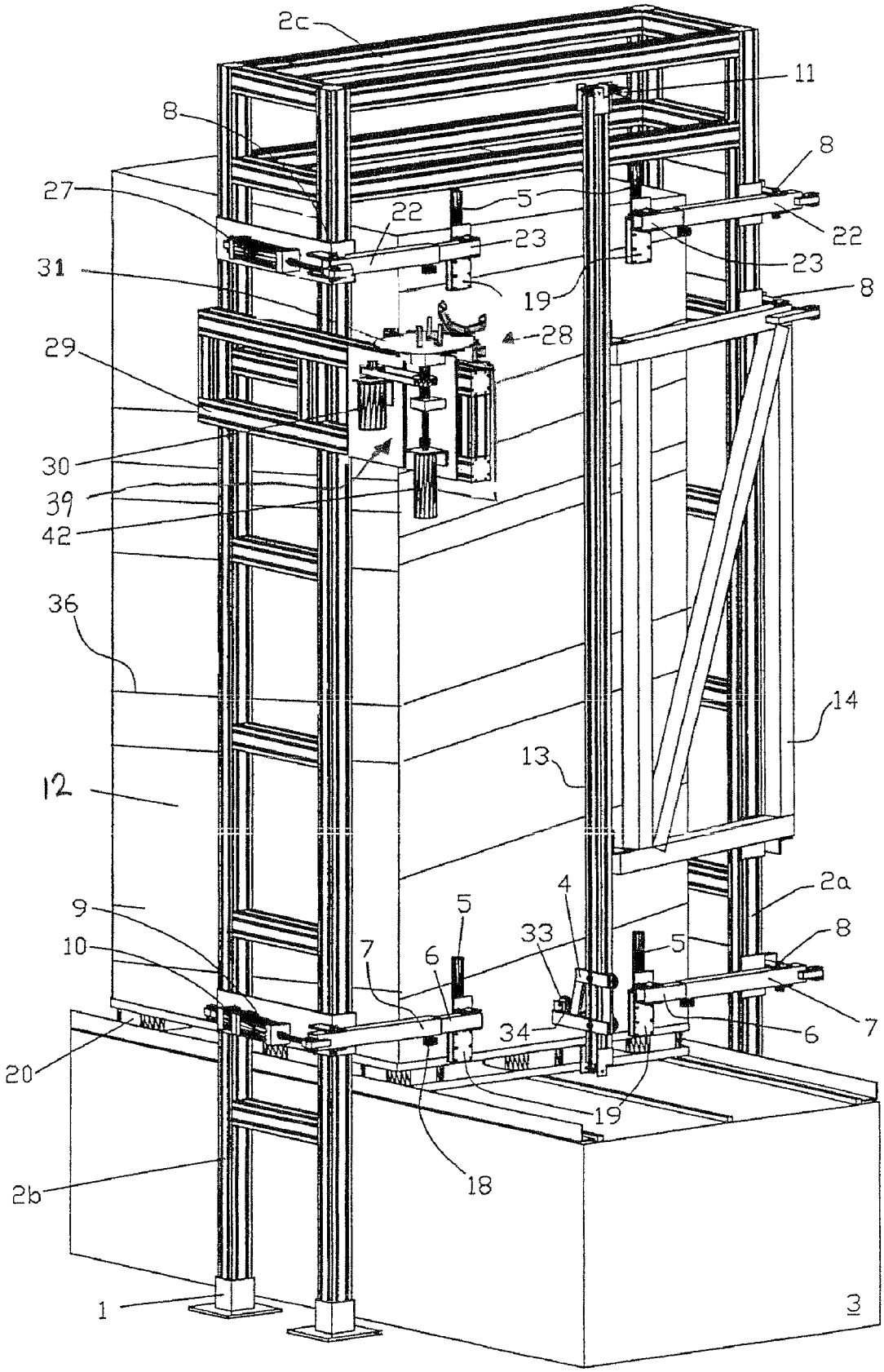
FIG. 1 is a rear perspective view of an unwrapping apparatus in accordance with certain embodiments of the invention.

The following detailed description should be read with reference to the drawings, in which like elements in different drawings are numbered identically. The drawings depict selected embodiments and are not intended to limit the scope of the invention. It will be understood that embodiments shown in the drawings and described below are merely for illustrative purposes, and are not intended to limit the scope of the invention as defined in the claims.

Figure 2:
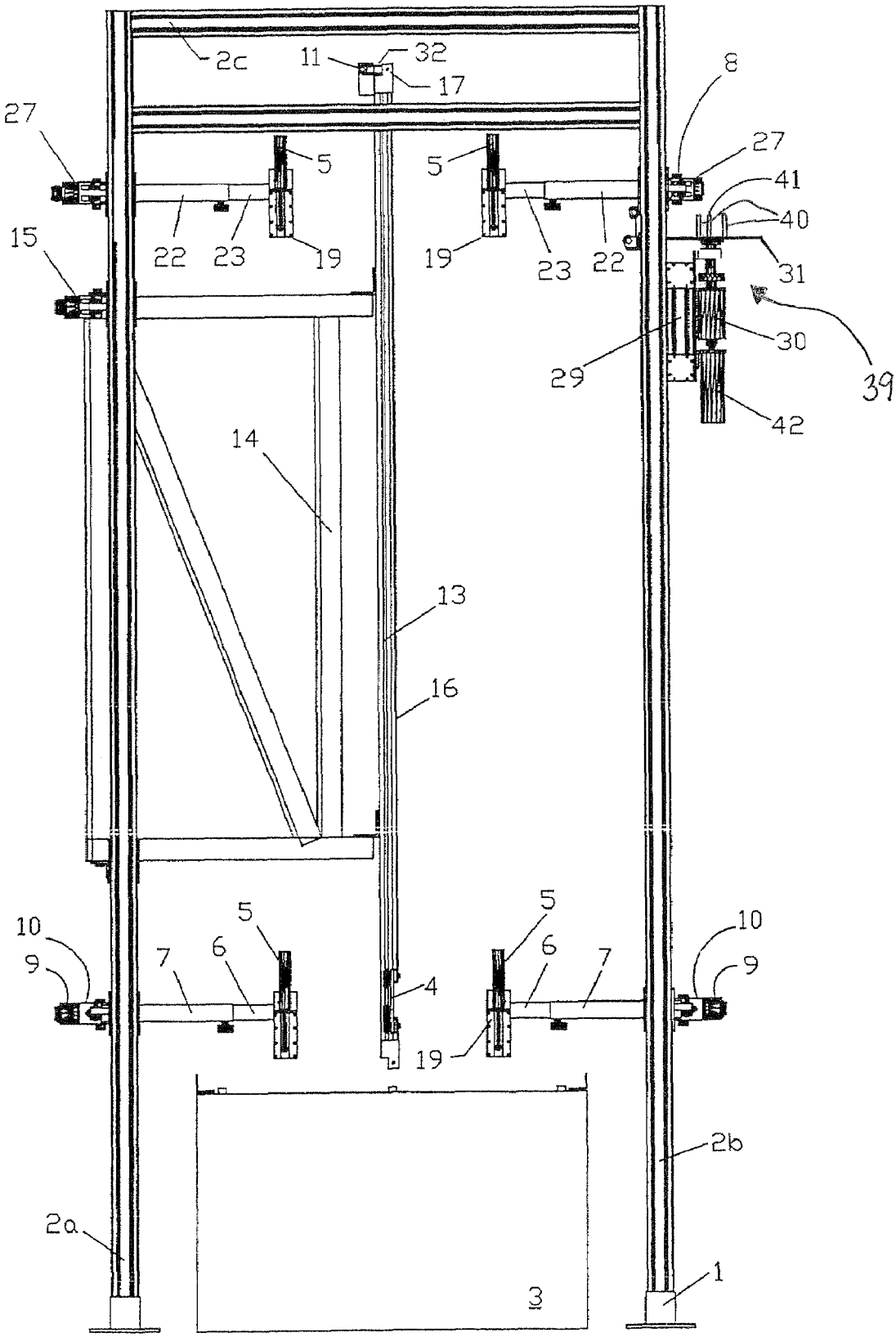
FIG. 2 is a front view of the unwrapping apparatus of FIG. 1.

FIG. 1 is a rear perspective view of an unwrapping apparatus 1 according to certain embodiments of the present invention, and FIG. 2 is a front view of the unwrapping apparatus 1, showing an engaging side. The unwrapping apparatus 1 is configured to unwrap a load 12, shown in FIG.

1. Generally, the load 12 is a palletized shrink, stretch, or plastic wrapped unit. Such load 12 is typically transported to a user (e.g., a facility, such as a bottling plant, a grocery store, a post office, etc.) and subsequently unwrapped. For the purposes of this description, left and right positions of the unwrapping apparatus 1 are referred to from the perspective of the load 12.

Referring to FIGS. 1 and 2, the unwrapping apparatus 1 includes a frame having at least two legs 2*a* and 2*b* that are connected by a connecting brace 2*c*. As such, while the apparatus 1 shown in FIG. 1 has two legs each of legs 2*a* and 2*b*, it should be appreciated that the apparatus 1 can likewise function with only single legs of legs 2*a* and 2*b*. The legs 2*a* and 2*b* are positioned from each other to maintain a space therebetween, the space being suitable for accommodating the load 12. A positioning element 3 is used to move the load 12 between the legs 2*a* and 2*b* and into a position to be unwrapped. In certain embodiments, the unwrapping apparatus 1 is positioned with the legs 2*a* and 2*b* straddling the positioning element 3. In certain embodiments, the positioning element 3 is a conveyor; however, any other mechanism for positioning the load 12 may be used. The positioning element 3 further moves the load 12 during and after unwrapping.

Figure 3A:
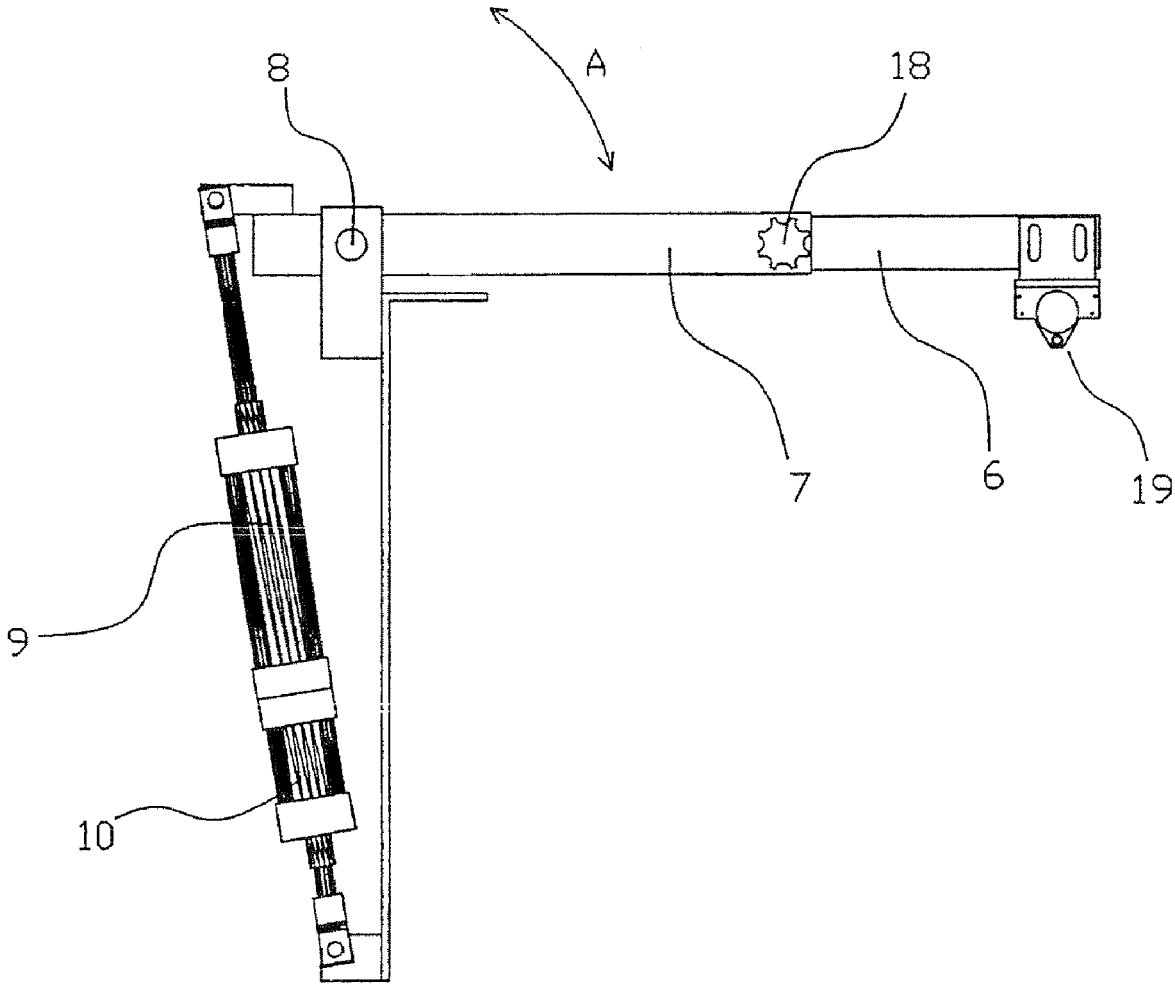
FIG. 3A is an enlarged top view of lower gripper arms in accordance with certain embodiments of the invention.

In certain embodiments, as shown in FIGS. 1, 2, and 3A, a lower gripper arm is attached to a lower portion of each leg 2*a* and 2*b*. In certain embodiments, each lower gripper arm is composed of two parts: a male gripper arm 6 and a female gripper arm 7. The male gripper arm 6 and female gripper arm 7 are provided for adjustability along the front of the load of gripper 19. More or fewer parts may be included in the lower gripper arm as desired. A pair of cylinders 9, 10 controls each lower gripper arm. Cylinder 10 (short stroke) provides a stretching motion. Cylinder 9 (long stroke) provides movement toward and away from the load 12. The lower gripper arm may be attached to each leg 2*a* and 2*b* by, for example, braces. However, any suitable attachment may be used. The stretch film 36 surrounding the load 12 is engaged by the grippers 19 using the arms and cylinders described above.

In certain embodiments, an upper gripper arm is attached to an upper portion of each leg 2*a* and 2*b*. In certain embodiments, each upper gripper arm is composed of two parts: a female gripper arm 22 and a male gripper arm 23. The upper gripper arm movement is controlled in a manner similar to that of the lower gripper arm, except only a single cylinder 27 is used to control the movement of the upper gripper arms. The attachment of the upper arm's cylinder 27 to the unwrapping apparatus 1 may be achieved by any suitable attachment. Optionally, the attachment may be the same as that of the lower gripper arm's cylinder 9 and 10 to the apparatus 1. The cylinder 27 engages the arm 22 in a substantially similar manner to that of the lower gripper assembly. A gripper 19 is attached to the free end of male arm 23. The upper grippers 19 are moved toward and away from the load 12 by using the cylinder 27.

While preferred embodiments of the gripper arms are herein described, it should be understood that any suitable configuration of gripper arms may be used to effectuate gripping of the stretch film 36. For example, gripper arms are well known in the art, and as such, one skilled in the art could use any such known gripper arms interchangeably herein.

Figure 3B:
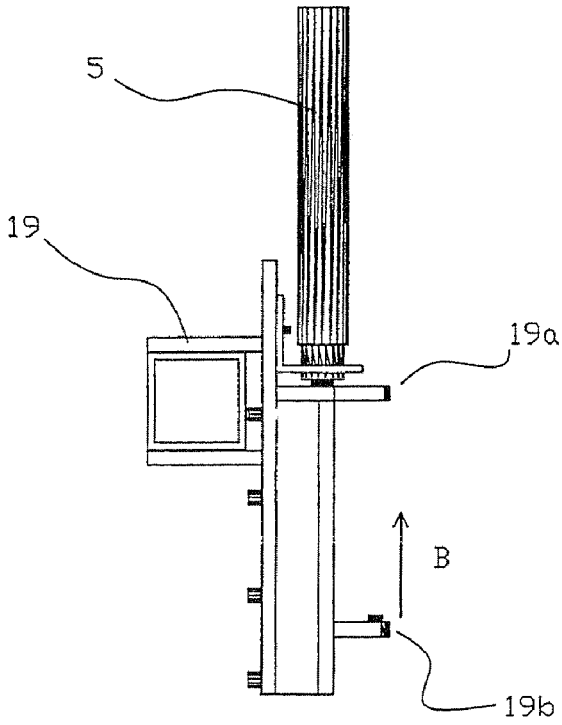
FIGS. 3B and 3C are enlarged side views of a gripper in accordance with certain embodiments of the invention.
Figure 3C:
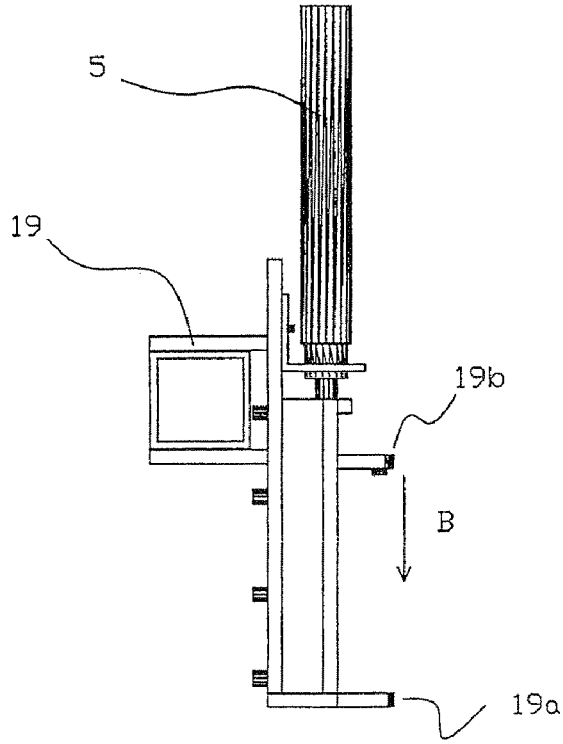

In certain embodiments, as shown in FIGS. 3A, 3B, and 3C, the upper and lower grippers 19 are moved toward the load 12 such that they engage the stretch film 36 by contacting the stretch film 36. The grippers 19 function by maintaining one of the upper or lower jaw stationary and moving the other jaw to the stationary jaw. The grippers 19 may be used to grip or release the stretch film by moving either jaw 19*a* or 19*b* towards or away from the other jaw 19*a* or 19*b* with, e.g., a pneumatic cylinder 5 or other suitable device. In order to pull the stretch film 36 away from the load 12 and into a position suitable for cutting with a cutter trolley 4, the lower grippers 19 pull the wrap away from the load 12. The movement of the lower grippers 19 is controlled by the lower arm stretch cylinder 10.

Referring to FIGS. 1 and 2, a cutting unit includes several components connected to the unwrapping apparatus 1 by a cutter swing arm 14, with the cutter swing arm 14 being attached to the left leg 2*a*. Optionally, the cutter swing arm 14 may be attached to the right leg 2*b* or the floor. In one embodiment, the cutter swing arm 14 is attached to either of the legs 2*a* or 2*b* via brackets and a linear or pivotal component, such as a bearing, in a manner that allows the cutter swing arm 14 to move freely toward and away from the load 12. However, any suitable device may be used to position the cutter swing arm 14 as long as it can move freely toward and away from the load 12. A cylinder 15, or other suitable control component, is used to control the movement of the cutter swing arm 14 as desired.

Figure 4A:
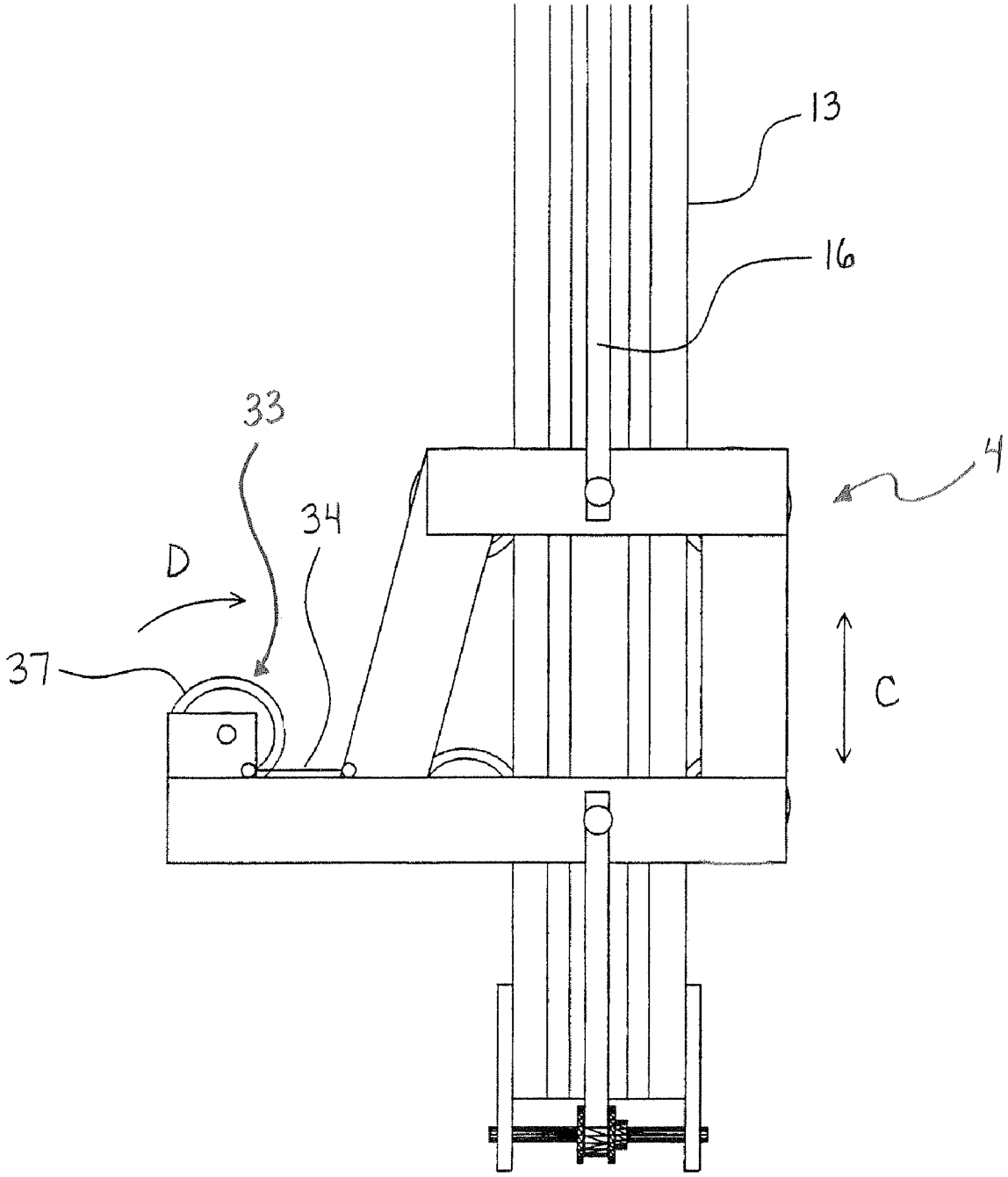
FIGS. 4A and 4B are enlarged side views of a cutting unit and cutting tool mechanisms, respectively, in accordance with certain embodiments of the invention.

As shown in FIGS. 1, 2, and 4A, the cutter trolley 4 is connected to a cutter slide bar 13, which is, in turn, connected to the cutter swing arm 14 (shown in FIGS. 1 and 2). The cutter slide bar 13 is used to move the cutter trolley 4 upward and downward along the load 12, while, as described above, the cutter swing arm 14 is used to position the cutter trolley 4 either toward or away from the load 12. As should be appreciated, use of both the cutter slide bar 13 and the cutter swing arm 14 enable the unwrapping apparatus 1 to sufficiently position the cutter trolley 4 for cutting the stretch film 36 from the load 12. This positioning of the cutter trolley 4 generally occurs once the load 12 is in position on the unwrapping apparatus 1 and the stretch film 36 has been pulled away from the load 12 by the lower grippers 19. While a preferred embodiment involves cutting the stretch film 36 from the bottom of the load 12 to the top of the load 12, the film 36 may be cut from the load 12 along any other suitable axis.

With reference to FIG. 4A, the cutter trolley 4 includes a guide wheel 33 and a cutting tool 34. The guide wheel 33 is used for guiding the stretch film 36 toward the cutter trolley 4 and into the cutting tool 34 thereof. The guide wheel 33 has a guiding face 37, i.e., the outer periphery of the guide wheel 33, used for contacting the stretch film 36 and subsequently conveying the film 36 into the cutting tool 34. The guiding face 37 is shaped to be entirely rounded. As such, upon contact by the stretch film 36 with the guiding face, there is reduced risk of the stretch film 36 catching or snagging on periphery of, or connections made to, the guide wheel 33. In addition, the guide wheel 33 is provided to turn only in one direction D, i.e., toward the roller trolley 4. As such, the potential for the stretch film 36 to contact the guide wheel 33 and cause rotation of the guide wheel 33 away from the roller trolley 4 is prevented. Thus, through these designs of the guide wheel 33, there is reduced risk in compromising the desired actions of the guide wheel 33. As can be appreciated, the cutting tool 34 is used for cutting the stretch film 36. In a preferred embodiment, the cutting tool 34 is a hot knife assembly.

Figure 4B:
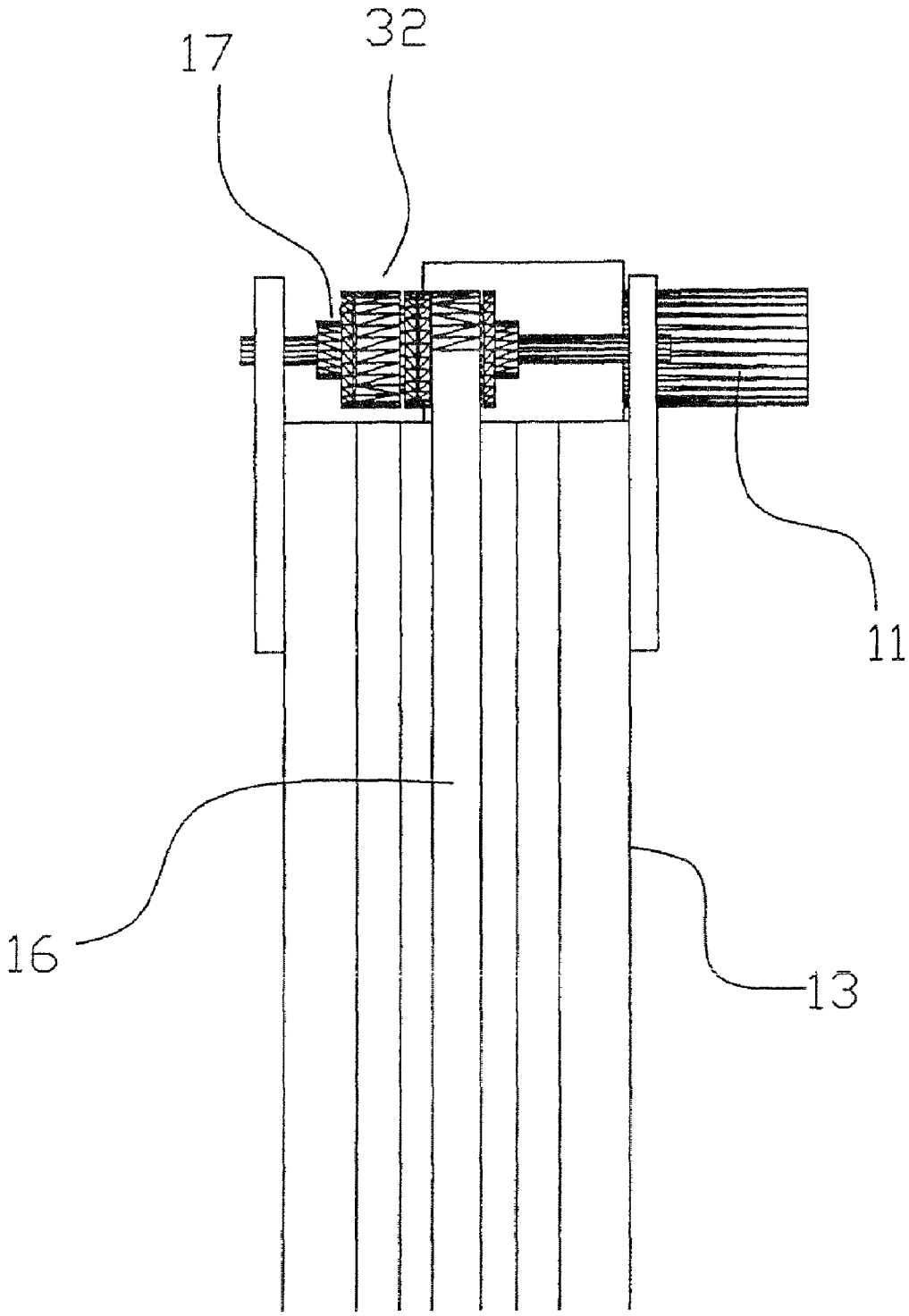

FIG. 4B illustrates an embodiment wherein a motor 11 and cutter trolley belt 16 drive the cutter trolley 4 along the cutter slide bar 13, via drive belt 32, thus effectuating a vertical cut along the length of the stretch film 36. Any other method of driving the trolley, for example, via a linear actuator or via manual means, can alternately be used.

Referring again to FIGS. 1 and 4A, both lower grippers are used to engage the film 36 and pull the film 36 away from the load 12 so that the cutter trolley 4 can be positioned via the cutter swing arm 14 and the cutter slide-bar 13 for cutting the film 36. In certain embodiments, the cutter trolley 4 is positioned so that the guide wheel 33 is behind the film 36 and the cutting tool 34 is below the film 36. In turn, the cutter trolley 4 is moved upwardly along the cutter slide-bar 13 so that the engaged film 36 turns the guide wheel 33, which in turn conveys the stretch film 36 away from the load 12 and into the cutter trolley 4 for subsequent cutting of the film 36 by the cutting tool 34, e.g., a hot knife.

Before the cutter trolley 4 reaches the same height as the upper grippers 19, the upper grippers 19 are moved toward the load 12 using the upper arm cylinder 27 to engage the stretch film 36 that has been conveyed away from the load 12 by the guide wheel 33. After the upper grippers grip the stretch film 36, the remaining film 36 is cut by moving the cutter trolley 4 upwardly to and through the top of the film 36. Once the stretch film 36 has been cut, the grippers 19 and slide-bar swing arm 14 are moved away from the load 12. At the same time, the load 12 is moved from its position and all but one of the grippers 19 release the stretch film 36. In certain embodiments, one of the upper grippers 19 maintains its grip on the stretch film 36 until it is secured onto a spooler unit 39.

While preferred embodiments of the gripper arms are herein described, it should be understood that any suitable quantity of gripper arms may be used to effectuate gripping of the stretch film 36. As such, in certain embodiments, at least one gripper 19 is included with the apparatus 1.

For example, as exemplified in FIG. 1, engaged face of the load 12 (i.e., leading face of the load 12 entering the apparatus 1) can have an elongated height dimension, e.g., extending from the positioning element 3 up nearly to the connecting brace 2*c*. In turn, as described above, one way to pull the stretch film 36 out from the load 12 across this height dimension is to use at least one lower gripper 19 and at least one upper gripper 19. However, it should be appreciated that one of the lower or upper grippers 19 can be solely used instead, depending on whether the stretch film 36 is initially cut from the bottom or top of the load 12. For example, as described above, if the stretch film 36 is initially cut from the bottom of the load 12 (near the positioning element 3), the lower gripper 19 can be solely used to pull the stretch film 36 from the load 12, enabling the initial cutting of the stretch film 36 by the cutting trolley 4. Once this cutting is started, the cutter trolley 4 can be used to cut the rest of the stretch film 36 along the above-described height dimension of the load 12 without the use of further upper grippers.

Similarly, as exemplified in FIG. 1, engaged face of the load 12 (i.e., leading face of the load 12 entering the apparatus 1) can have an elongated width dimension, e.g., extending nearly from one leg 2*a* to the other leg 2*b* of the apparatus 1. In turn, as described above, one way to pull the stretch film 36 out from the load 12 across this width dimension is to use grippers 19 that are generally horizontally aligned and extend from both of the legs 2*a* and 2*b*. In turn, the cutting trolley 4 can be located between the grippers 19 to initially cut the stretch film 36. However, it should be appreciated that one of these grippers 19 extending from the legs 2*a* and 2*b* can be solely used instead, so long as the one gripper 19 is able to pull the stretch wrap out from the load 12 to enable subsequent cutting of the stretch film 36 by the cutting trolley 4.

For example, if the stretch film 36 is to be initially cut near the bottom edge of the stretch film 36 at a central extent of the width dimension, one lower gripper 19 extending from one of the legs 2*a* or 2*b* can be used to pull the stretch film 36 from the load 12 proximate to this extent, enabling the initial cutting of the stretch film by the cutting trolley 4. As should be appreciated, this one gripper 19 may need to be extended in length so as to grip the stretch wrap proximate to this central extent. Alternately, the apparatus 1 may be designed to initially cut the stretch film 36 closer to one end of the width dimension, for example, near the bottom edge of the stretch film 36. In turn, one lower gripper 19 (extending from the leg 2*a* or 2*b* closest to the one end) can be used to pull the stretch film 36 away from the load 12 to facilitate cutting by the cutting trolley 4 on the one end. In such configuration, the one gripper 19 would generally not need to be extended in length as described above.

As should be appreciated, in light of the above description regarding limiting the quantity of grippers 19, the apparatus 1 can be configured to use a single gripper 19 as opposed to using pairs of lower and upper grippers, as described herein. In certain embodiments, this one gripper 19 is an upper gripper positioned on the leg 2*a* or 2*b* proximate to the roller guide 28 and spooler unit 39 so as to be able to load the cut stretch film 36 onto the spooler unit 39 and subsequently to unload the spooled cut stretch film 36 from the spooler unit 39, as described below.

Figure 5:
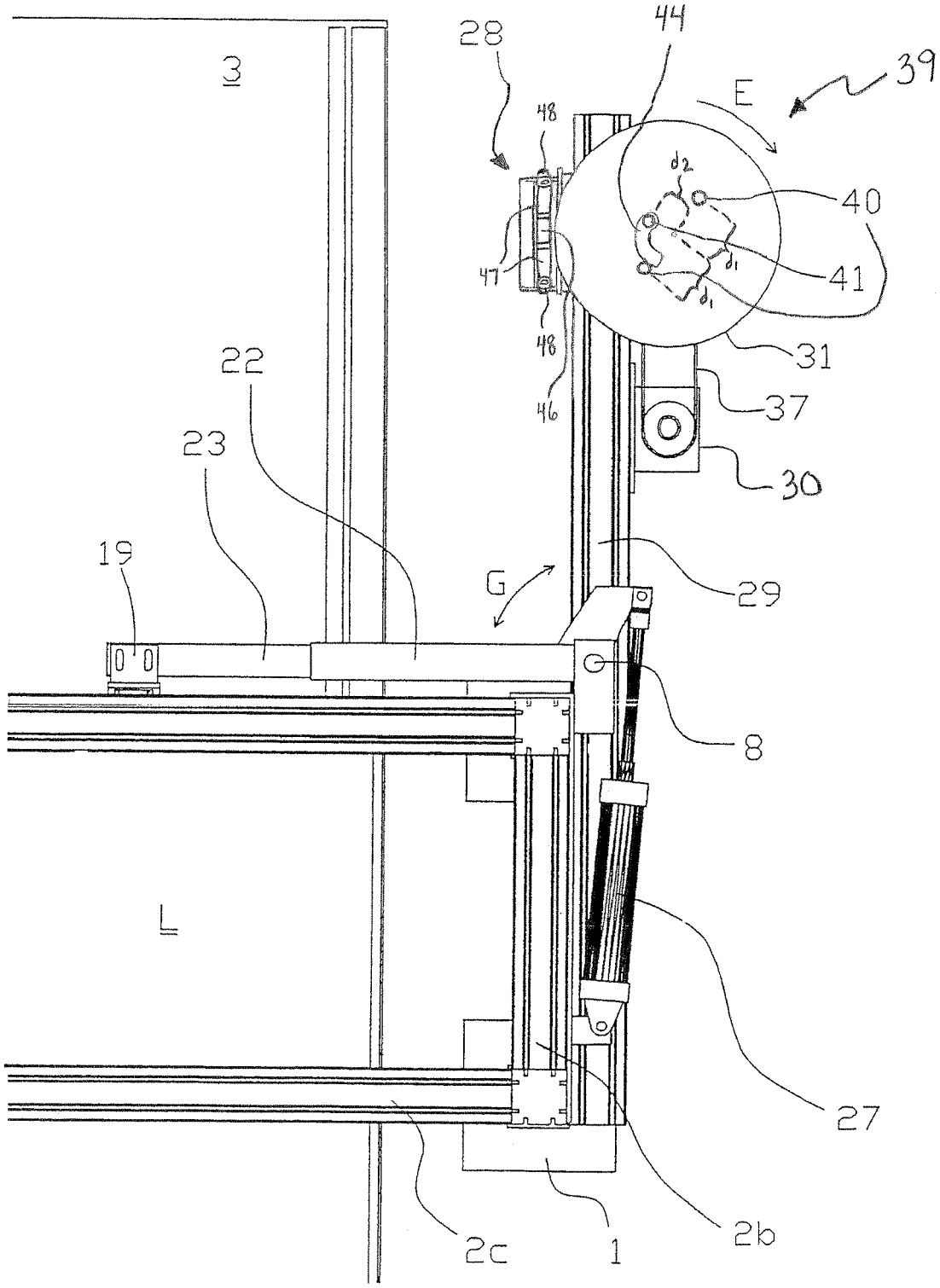
FIG. 5 is a top view of an upper gripper arm, a roller guide and a spooler unit in accordance with certain embodiments of the invention.
Figure 6B:
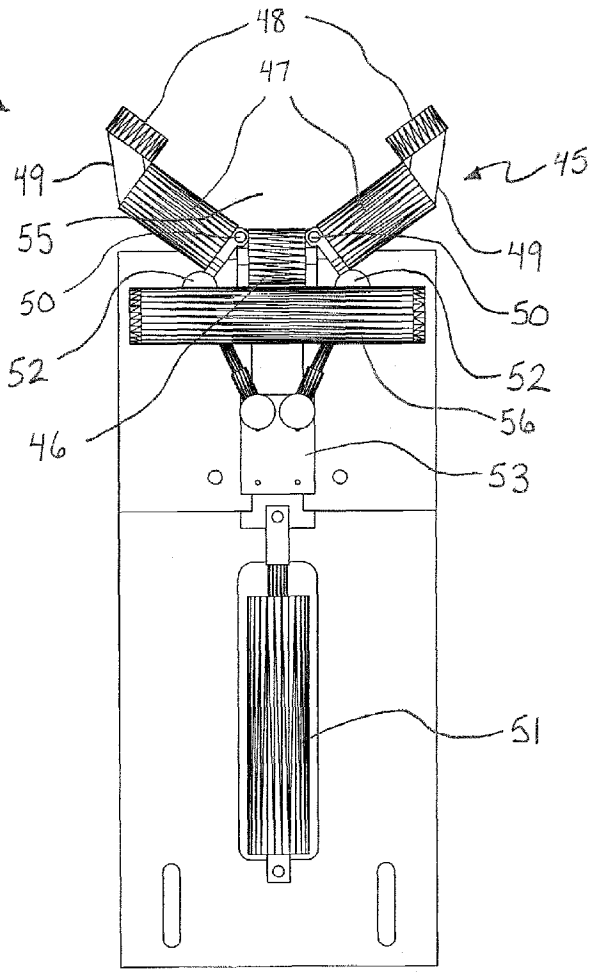
FIGS. 6A and 6B are front views of the roller guide of FIG. 5 in accordance with certain embodiments of the invention.
Figure 6A:
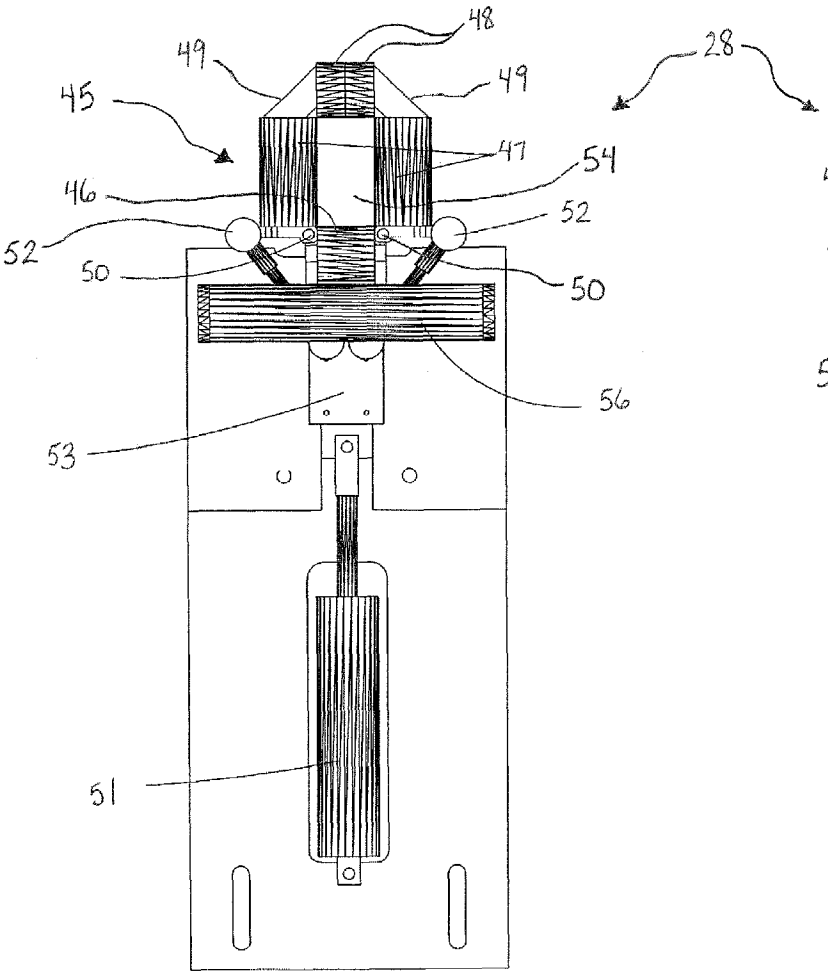

Referring to FIG. 5, the stretch film 36, once cut, is threaded across a roller guide 28 onto the spooler unit 39 by the upper right gripper 19. As described above, the cylinder 27, or other suitable device, controls the position of the upper arm 22, 23 connected to the gripper 19. The roller guide 28 is configured to align the stretch film 36 into the spooler unit 39 while it rotates. As shown in FIGS. 6A and 6B, the roller guide 28 includes an upper assembly 45 used to define regions through which the film 36 can be fed when the film 36 is initially loaded and subsequently collected on the spooler unit 39. In certain embodiments, the assembly 45 includes a plurality of rollers. In certain embodiments, the assembly 45 includes a lower roller 46, two side rollers 47, a set of upper rollers 48, as well as a bottom roller 56. The assembly 45 includes a pair of jaw-like roller members 49, with each side member 49 including one of the side rollers 47 and one of the set of upper rollers 48. In certain embodiments, as illustrated in FIGS. 6A and 6B, each of the pair of jaw-like roller members 49 is pivotably connected to the lower roller 46 via a pivot pin 50. In turn, the roller members 49 are selectively pivotable to be in either an open position (as shown in FIG. 6A) or a closed position (as shown in FIG. 6B), whereby the positioning of the roller members 49 in turn defines the region through which the stretch film 36 is fed.

As can be appreciated, the pivoting movement of the roller members 49 can be provided in a number of ways. For example, in certain embodiments, as shown, such pivoting movement is provided via action of a cylinder 51. The cylinder 51, in certain embodiments, can function with a pair of tie rods 52, each accommodating the opening and closing of one of the roller members 49. For example, as shown in FIGS. 6A and 6B, the cylinder 51 is operatively connected to a push block 53 which, in turn, is connected to lower ends of the tie rods 52. Upper ends of the tie rods 52 are further connected to outer edges of the roller members 49. As such, upon movement of the push block 53 away from the cylinder 51 (as shown in FIG. 6A), the upper portions of the tie rods 52 are, in turn, spread apart from each other. This spreading of the upper portions of the tie rods 52 causes each of the roller members 49 to pivot about the corresponding pivot pins 50 so as to both be positioned in their closed positions. In contrast, upon movement of the push block 53 toward the cylinder 51 (as shown in FIG. 6B), the upper portions of the tie rods 52 are, in turn, pulled toward each other. This movement of the upper portions of the tie rods 52 causes each of the roller members 49 to pivot about the corresponding pivot pins 50 so as to be positioned in their open positions.

In certain embodiments, when the cylinder 51 is engaged, the push block 53 is pushed away from the cylinder 51, thereby providing a closed position for each of the roller members 49. As shown in FIG. 6B, in the closed positions, the roller members 49 push the set of upper rollers 48 together, with the lower roller 46 and the roller members 49 forming a region, i.e., an aperture 54, through which the cut film 36 can be fed and subsequently collected by the spooler unit 39. Conversely, as shown in FIG. 6A, when the cylinder 51 is disengaged, the push block 53 is released by the cylinder 51. In turn, the push block 53 recoils back toward the cylinder 51. As a result, the roller members 49 retract from their closed positions to their open positions thereby forming an open region 55 through which the cut film 36 can be initially fed and subsequently secured on the spooler unit 39. It should be appreciated that the above can likewise be provided with a cylinder that when engaged has a recoiling motion. In addition, one could instead use mechanisms other than the cylinder 51, push block 53, and/or tie rods 52 to facilitate the closing and opening positions of the roller members 49.

As described above, the roller guide 28 is configured to form the region 55 and aperture 54 through which the stretch film 36 can be suitably aligned when the film 36 is collected and fed onto the spooler unit 39. For example, when the stretch film 36 is initially fed onto spooler unit 39 via the gripper 19, the film 36 extending from the gripper 19 across the guide roller 28 tends to be more expansive in shape than when it is secured onto the spooler unit 39 and subsequently collected. As such, with reference to FIG. 6B, the roller members 49 of the upper assembly 45 are initially positioned in their open positions so as to form an expanded area, i.e., the region 55, for accommodating such stretch film 36. Conversely, as the gripper 19 pulls the stretch film 36 across the roller guide 28 so that the film 36 can be secured to and collected by the spooler unit 39, the stretch film 36 that extends across the guide roller 28 tends to be pulled tight, being less expansive in shape. As such, with reference to FIG. 6A, the roller members 49 of the upper assembly 45 are positioned in their closed positions to form the aperture 54 through which the film 36 can be drawn.

As shown in FIGS. 6A and 6B, because the roller members 49 and adjoined lower roller 46 have no inner protrusions extending therefrom, the stretch film 36 can pass freely through either the aperture 54 or region 55 without risk of being caught or snagged on the upper assembly 45 of the roller guide 28. Further, with each of the set of upper rollers 48 generally extending toward each other and being substantially perpendicular to the corresponding side rollers 47 of the roller members 49, the upper assembly forms the region 55 or aperture 54 over or through which the stretch film 36 can be effectively contained. As a result, the design of the roller guide 28 provides for effective passage and alignment of the stretch film 36 when such film 36 is passed to the spooler unit 39.

Figure 7:
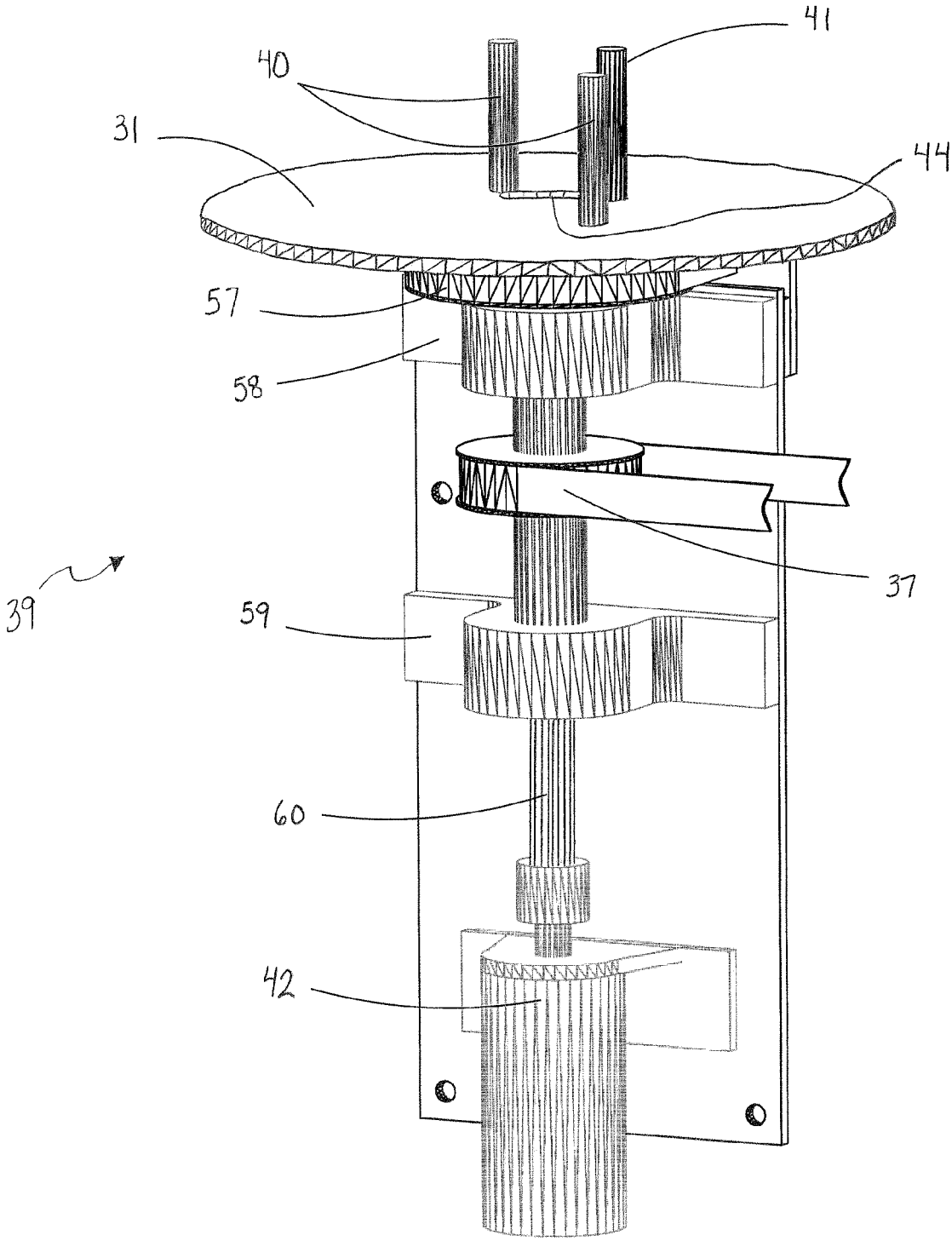
FIG. 7 is a front perspective view of the spooling unit of FIG. 5 in accordance with certain embodiments of the invention.
Figure 8A:
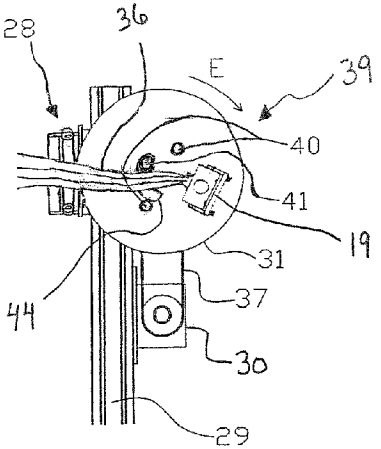
FIGS. 8A, 8B, 8C, 8D, and 8E are top views of operations of the spooler unit and the roller guide of FIG. 5 and disposal of wound wrap by the gripper arm of FIG. 5.
Figure 8B:
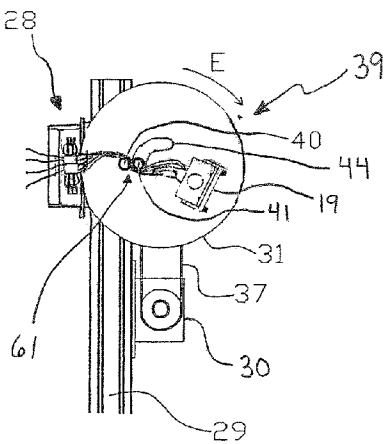
Figure 8C:
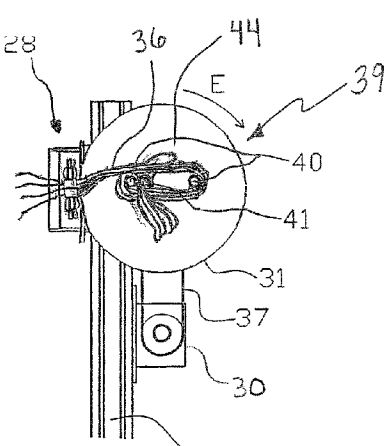
Figure 8D:
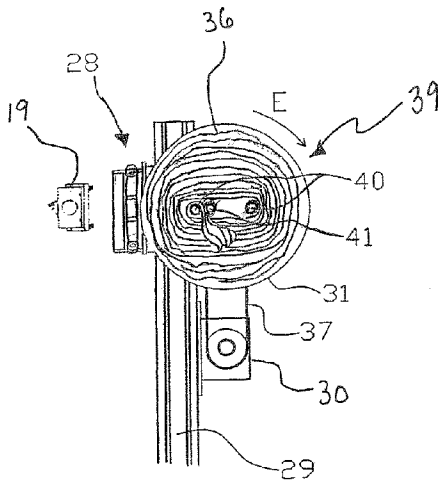
Figure 8E:
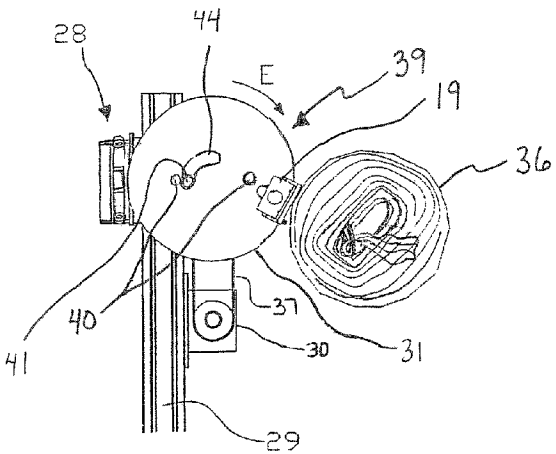
Figure 9A:
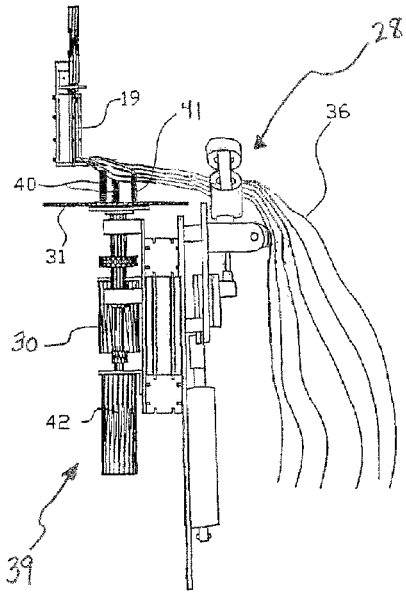
FIGS. 9A, 9B, 9C, 9D, and 9E are side views of operations of the spooler unit and the roller guide of FIG. 5 and disposal of wound wrap by the gripper arm of FIG. 5.
Figure 9B:
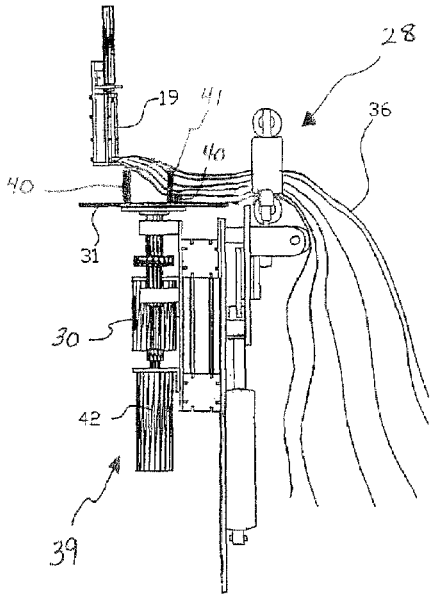
Figure 9C:
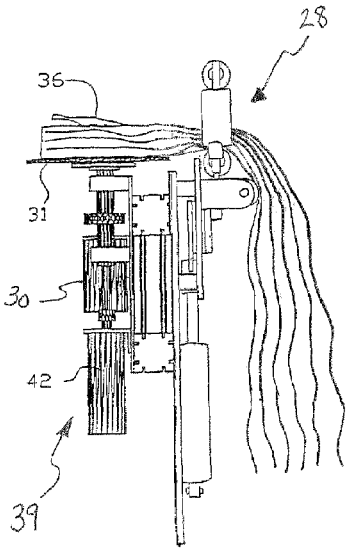
Figure 9D:
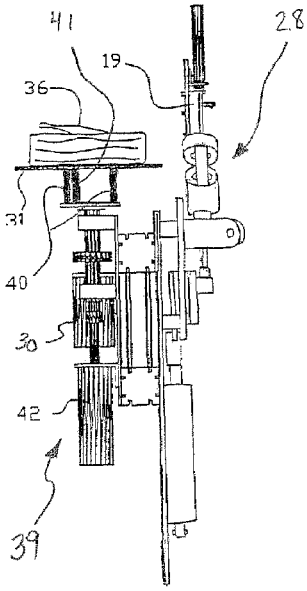
Figure 9E:
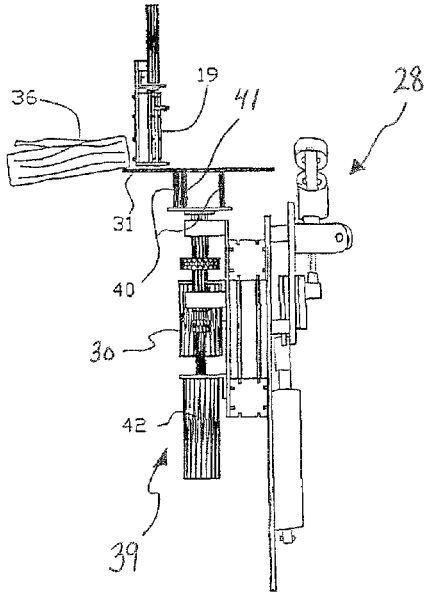

In certain embodiments, as shown in FIG. 5, the spooler unit 39 and the roller guide 28 are connected to the right leg 2*b* by the spooler support arm 29. In certain embodiments, the spooler unit 39, as shown in FIG. 7, includes, among other components, a stripper plate 31, one or more spooler forks 40, and a shuttle pin 41. In certain embodiments, as shown in FIGS. 1, 2, 5, 7, 8A-8E, and 9A-9E, the spooler unit 39 includes a plurality of spooler forks 40; however, it should be appreciated that one or more than two spooler forks 40 can be used with the spooler unit 39 as well. In certain embodiments, the spooler forks 40 and the shuttle pin 41 extend through the stripper plate 31 and are substantially perpendicular in their extent to an upper surface of the stripper plate 31. Each of the spooler forks 40 are located a first distance $d_1$ from the center point of the upper surface of the stripper plate, while the shuttle pin 41 is located a second distance $d_2$ from the center point of the upper surface of the stripper plate 31. In certain embodiments, the second distance $d_2$ is less than the first distance $d_1$. The spooler forks 40 and shuttle pin 41 are rotated by spooler drive belt 37 which is, in turn, powered by a spooler motor 30. When the stretch film 36 has been aligned via the roller guide 28 so as to be subsequently secured onto the spooler unit 39, the stripper plate 31 is rotated by the spooler drive belt 37 to initially captivate the stretch film 36 via one of the spooler forks 40 and the shuttle pin 41.

With reference to FIGS. 5, 7, and 8A-8E, the stripper plate 31 includes a channel 44, with the shuttle pin 41 being movable within the channel 44. Proximate to a first end of the channel 44 is one of the spooler forks 40. In certain embodiments, as the stretch film 36 is initially conveyed onto the spooler unit 39 via the gripper 19, the shuttle pin 41 is located within the channel 44 at a second end thereof. As such, the one spooler fork 40 and the shuttle pin 41 are spaced apart from each other. In turn, as the stretch film 36 is initially conveyed onto the spooler unit 39, the film 36 extends between the one spooler fork 40 and the shuttle pin 41. Upon initial rotation of the stripper plate 31, the shuttle pin 41 moves within the channel 44 to rotate to the first end thereof, thereby being in close proximity to the one spooler fork 40. In turn, the shuttle pin 41 and the one spooler fork 40 form a narrow space 61 therebetween (referenced in FIG. 8B), which accommodates a portion of the film 36. The narrow space 61, in essence, enables the shuttle pin 41 and the one spooler fork 40 to captivate or secure the portion of the film 36 during collection of the film 36 by the spooler unit 39. Once the stretch film 36 has been captivated, the gripper 19, preferably the upper right gripper or the upper left gripper, releases the stretch film 36 and the spooler forks 40 and shuttle pin 41 continue to rotate via the spooler motor 30 until all of the stretch film 36 has been spooled.

In certain embodiments, the stripper plate 31 is a flat plate having at least one bore therein for receiving each of the spooler forks 40 and having at least one slot for receiving the shuttle pin 41. The stripper plate 31 is configured for upward and downward movement such that the plate 31 may be slid over the spooler forks 40 and the shuttle pin 41 to separate the collected stretch film 36 from the spooler unit 39. Referring to FIGS. 7, and 9A-9E, a stripper cylinder 42 is actuated to move the stripper 31 upward along the spooler forks 40 and the shuttle pin 41 to strip the spooled wrap 36 off of the forks 40 and the pin 41. In certain embodiments, the gripper 19 which previously maintained the hold on the stretch film 36 while being conveyed to the spooler unit 39 is moved again toward the spooler unit 39 and pushes the spooled wrap 36 into a bin for disposal. Upon this unloading of the film 36 from the stripper plate 31, the stripper cylinder 42 is actuated to move the stripper 31 downward along the spooler forks 40 and the shuttle pin 41. Subsequently, the stripper plate is rotated opposite its normal direction E to position the one spooler fork 40 and the shuttle pin 41 apart from each other in order to captivate and collect further film 36 in further operations of the apparatus 1.

It is noted that any other mechanism for disposing the film 36 in keeping with the present invention may alternately be used.

Thus, in summary, in certain embodiments, the unwrapping apparatus 1 operates as follows. The apparatus 1 receives the load 12 with the swing arms in an open or load pass position. When the load 12 is positioned for unwrapping, for example via conveyor, the two lower gripper arms are moved towards the load 12 such that the gripper jaws contact the stretch film 36. The gripper cylinders 5 are actuated to grip the film 36 and the short cylinders 10 on the lower arms are retracted to move the grippers 19 away from the load 12, thereby pulling the wrap away from the load 12. The cutter swing arm 14 is actuated to position the cutter trolley 4 at the bottom of the load 12. The cutter trolley motor 11 is activated to move the cutter trolley 4 upward. The guide wheel 33 and cutting tool 34 engage the wrap for cutting as the cutter trolley 4 moves upward; the trolley 4 moving upward until it reaches the upper gripper height. Before which, the upper grippers 19 were actuated to move toward the load 12 and engage and grip the wrap 36. The cutter trolley 4 then completes the upward cutting of the wrap 36. With the wrap 36 cut from bottom to top, each of the arms is actuated away from the load 12 thus providing an opening for the unwrapped load 12. The load 12 is subsequently conveyed away from the apparatus 1 with the film 36 suspended by the grippers 19.

Further, with reference to FIGS. 8A-8E and 9A-9E, in certain embodiments, all but one of the grippers 19, preferably one of the upper grippers 19, release the film 36, with the final gripper 19 being actuated to continue its arc, threading the wrap through guide roller 28 and onto the spooler unit 39. The guide roller 28 is set to be in the open position when the film 36 is initially conveyed onto the spooler unit 39. Once the film 36 is threaded between one of the spooler forks and the shuttle pin 41 of the stripper plate 31 of the spooler unit 39, the stripper plate 31 of the spooler unit 39 is made to rotate, thereby captivating the film 36 between the one spooler fork 40 and the shuttle pin 41, followed by the final gripper 19 releasing the film 36 and extending inward from the spooler unit 39. Shortly following such captivation of the film 36 and extending of the final gripper 19, the roller guide is engaged to be in a closed position. The stripper plate 31 of the spooler unit 39 rotates until the entire film 36 is spooled. Upon collection of the entire film 36, the roller guide 28 is set to be in the open position. The stripper plate 31 is moved upward, stripping the collected, spooled film 36 off of the spooler forks 40 and the shuttle pin 41. The gripper 19 is then retracted toward the spooled film 36 to deposit the film 36 into an appropriate container. In certain embodiments, one of the grippers 19 is used to knock the spooled film 36 into a bin for disposal.

While the above-described designs concerning the roller guide 28 and the spooler unit 39 are shown as being incorporated together on the unwrapping apparatus 1, this involves but one embodiment of the invention. It should be appreciated that other embodiments of the invention, e.g., where only one of the roller guide 28 and the spooler unit 39 designs is implemented, can alternately be provided, while still falling within the spirit of the invention. Further, the present invention may be embodied in other specific forms without departing from the spirit or essential attributes thereof and accordingly reference should be made to the appended claims rather than to the foregoing specification as indicating the scope of the invention.

What is claimed is:

1. An unwrapping apparatus for removing stretch film from a stretch wrapped, palletized load, the unwrapping apparatus comprising:

a frame having at least two upright legs operatively connected to maintain a space therebetween, the space being suitable for accommodating the load;

at least one gripper configured for engaging the film and pulling the film from the wrapped load, the at least one gripper being connected to one of the upright legs and being movable toward and away from the load;

a cutting unit carrying a cutting tool for cutting the film, the cutting unit being carried by the frame and being movable upward and downward and toward and away from the load; and a spooler unit carried by the frame for collecting the film after the film has been cut by the cutting unit, the spooler unit including a roller guide for aligning the cut film when collected by the spooler unit, the roller guide including at least two roller members which can be selectively positioned in one of an open position or a closed position, the roller members in their open positions forming a region over which the cut film can be pulled and subsequently secured to the spooler unit, the roller members in their closed positions forming an aperture through which the cut film can be pulled during collection of the cut film by the spooler unit.

2. The unwrapping apparatus of claim 1, wherein the roller guide includes an upper assembly, the upper assembly including a lower roller, two side rollers, and a set of upper rollers.

3. The unwrapping apparatus of claim 2, wherein the roller members each include a side roller and one of the set of upper rollers.

4. The unwrapping apparatus of claim 2, wherein each of the roller members is pivotably connected to the lower roller.

5. The unwrapping apparatus of claim 1, wherein the region and aperture formed when the roller members are in the corresponding open and closed positions are without inner protrusions.

6. The unwrapping apparatus of claim 1, wherein the region formed by the roller members in their open positions is expanded in area as compared to the aperture formed by the roller members in their closed positions.

7. The unwrapping apparatus of claim 1, wherein the region formed by the roller members in their open positions can accommodate more expansive shapes of the cut film as compared to the aperture formed by the roller members in their closed positions.

8. The unwrapping apparatus of claim 1, wherein the cutting unit includes a guide wheel for guiding the film into the cutting tool of the cutting unit, the guide wheel having an outer surface being entirely rounded and configured to only rotate in a direction toward the cutting unit.

9. The unwrapping apparatus of claim 1, wherein the spooler unit comprises a stripper plate, a plurality of spooler forks, and a shuttle pin, wherein the shuttle pin is movable within a channel of the stripper plate to rotate within close proximity of one of the plurality of spooler forks during rotation of the stripper plate.

10. The unwrapping apparatus of claim 9, wherein the shuttle pin and the one spooler fork form a narrow space therebetween during rotation of the stripper plate, the narrow space accommodating a portion of the cut film and enabling the shuttle pin and the one spooler fork to secure the cut film portion during collection of the cut film by the spooler unit.

11. An unwrapping apparatus for removing stretch film from a stretch wrapped, palletized load, the unwrapping apparatus comprising:

a frame having at least two upright legs operatively connected to maintain a space therebetween, the space being suitable for accommodating the load;

at least one gripper configured for engaging the film and pulling the film from the wrapped load, the at least one gripper being connected to one of the upright legs and being movable toward and away from the load;

a cutting unit carrying a cutting tool for cutting the film, the cutting unit being carried by the frame and being movable upward and downward and toward and away from the load; and a spooler unit carried by the frame for collecting the film after the film has been cut by the cutting unit, the spooler unit comprising a stripper plate, one or more spooler forks, and a shuttle pin, the shuttle pin movable within a channel of the stripper plate to rotate within close proximity of one of the spooler forks during rotation of the stripper plate, the shuttle pin and the one spooler fork forming a narrow space therebetween during rotation of the spooler unit, the narrow space accommodating a portion of the cut film and enabling the shuttle pin and the one spooler fork to secure the cut film portion during collection of the cut film by the spooler unit.

12. The unwrapping apparatus of claim 11, wherein the one or more spooler forks comprise a plurality of spooler forks.

13. The unwrapping apparatus of claim 11, wherein the one or more spooler forks and the shuttle pin extend through the stripper plate and are substantially perpendicular in their extent to an upper surface of the stripper plate.

14. The unwrapping apparatus of claim 11, wherein the one or more spooler forks are located a first distance from a center point of an upper surface of the stripper plate, and the shuttle pin is located a second distance from the center point of the upper surface of the stripper plate.

15. The unwrapping apparatus of claim 14, wherein the second distance is less than the first distance.

16. The unwrapping apparatus of claim 11, wherein the shuttle pin is movable within the channel to rotate away from the one spooler fork following collection and disposal of the cut film.

17. The unwrapping apparatus of claim 11, wherein the cutting unit includes a guide wheel for guiding the film into the cutting tool of the cutting unit, the guide wheel having an outer surface being entirely rounded and configured to only rotate in a direction toward the cutting unit.

18. The unwrapping apparatus of claim 11, wherein the spooler unit includes a roller guide for aligning the cut film when collected by the spooler unit, the roller guide including two roller members which can be selectively positioned in one of an open position or a closed position.

19. The unwrapping apparatus of claim 18, wherein the roller members in their open positions form a region over which the cut film can be pulled and subsequently secured to the spooler unit.

20. The unwrapping apparatus of claim 18, wherein the roller members in their closed positions form an aperture through which the cut film can be pulled during collection of the cut film by the spooler unit.

21. An unwrapping apparatus for removing stretch film from a stretch wrapped, palletized load, the unwrapping apparatus comprising:

a frame having at least two upright legs operatively connected to maintain a space therebetween, the space being suitable for accommodating the load;

at least one gripper configured for engaging the film and pulling the film from the wrapped load, the at least one gripper being connected to one of the upright legs and being movable toward and away from the load;

a cutting unit carrying a cutting tool for cutting the film, the cutting unit being carried by the frame and being movable upward and downward and toward and away from the load; and a spooler unit carried by the frame for collecting the film after the film has been cut by the cutting unit, the spooler unit including a roller guide for aligning the cut film when collected by the spooler unit, the roller guide including at least two roller members which can be selectively positioned in one of an open position or a closed position, the spooler unit including a stripper plate, at least one spooler fork, and a shuttle pin, the shuttle pin movable within a channel of the stripper plate to rotate within close proximity of one of the spooler forks during rotation of the stripper plate to secure the cut film portion during collection of the cut film by the spooler unit.

22. The unwrapping apparatus of claim 21, wherein the roller members in their open positions form a region over which the cut film can be pulled and subsequently secured to the spooler unit.

23. The unwrapping apparatus of claim 21, wherein the roller members in their closed positions form an aperture through which the cut film can be pulled during collection of the cut film by the spooler unit.

24. The unwrapping apparatus of claim 21, wherein the shuttle pin and the one spooler fork form a narrow space therebetween during rotation of the spooler unit, the narrow space accommodating a portion of the cut film and enabling the shuttle pin and the one spooler fork to secure the cut film portion.

* * * * *